US005915364A

United States Patent [19]

Katou et al.

[11] Patent Number: 5,915,364

[45] Date of Patent: Jun. 29, 1999

[54] CANISTER FOR USE IN EVAPORATIVE EMISSION CONTROL SYSTEM FOR AUTOMOTIVE VEHICLE

[75] Inventors: Naoya Katou, Ama-gun; Hideaki Itakura; Tohru Yoshinaga, both of Okazaki; Tokio Kohama, Nishio; Katsuo Azegami, Toyokawa; Kazuto Maeda; Nobuhiko Koyama, both of Nagoya, all of Japan

[73] Assignees: Denso Corporation, Kariya; Nippon Soken, Inc., Nishio, both of Japan

[21] Appl. No.: 08/866,109

[22] Filed: May 30, 1997

[30] Foreign Application Priority Data

May 30, 1996 [JP] Japan ..... 8-160982

[51] Int. Cl.[6] ..... F02M 37/04

[52] U.S. Cl. ..... 123/519; 123/520

[58] Field of Search ..... 123/518, 520, 123/519, 516, 521

[56] References Cited

U.S. PATENT DOCUMENTS

| | | | |
|---|---|---|---|
| 5,398,660 | 3/1995 | Koyama et al. . | |
| 5,564,398 | 10/1996 | Maeda | 123/520 |
| 5,623,911 | 4/1997 | Kiyomiya | 123/520 |
| 5,632,808 | 5/1997 | Harn | 123/519 |

FOREIGN PATENT DOCUMENTS

| | | | |
|---|---|---|---|
| 55-119419 | 9/1980 | Japan . | |
| 60-127465 | 8/1985 | Japan . | |
| 62-20159 | 2/1987 | Japan . | |
| 63-82062 | 5/1988 | Japan . | |
| 0215959 | 8/1990 | Japan | 123/519 |
| 5-133287 | 5/1993 | Japan . | |
| 5-321776 | 12/1993 | Japan . | |
| 7-12018 | 1/1995 | Japan . | |

*Primary Examiner*—Carl S. Miller

*Attorney, Agent, or Firm*—Pillsbury Madison & Sutro, LLP

[57] ABSTRACT

A canister for use in an evaporative emission control system of an automotive vehicle is provided which includes a box-like casing, an inlet port formed in one end wall of the casing through which fuel vapors generated within a fuel tank are drawn into the canister, and a plurality of vapor-adsorbing passages each of which is filled with activated carbon and has a given length through which the fuel vapors drawn through the inlet port flow. The vapor-adsorbing passages are all arranged within said casing in parallel to each other. This arrangement allows the casing to be of a flat shape which facilitates easy installation of the canister within a flat space around a fuel tank.

15 Claims, 12 Drawing Sheets

CANISTER FOR USE IN EVAPORATIVE EMISSION CONTROL SYSTEM FOR AUTOMOTIVE VEHICLE

BACKGROUND OF THE INVENTION

1. Technical Field

The present invention relates generally to an evaporative emission control system for automotive vehicles designed to capture fuel vapors evaporated within a fuel tank for preventing the fuel vapors from escaping outside the vehicle, and more particularly an improved structure of a canister for use in an evaporative emission control system.

2. Background of Related Art

Automotive vehicles are typically equipped with an evaporative emission control system having a canister filled with an adsorbent such as activated carbon which captures therein fuel vapors generated from a fuel tank and then releases them to an intake air pipe when the engine starts for preventing the fuel vapors from escaping out of the vehicle.

In order to meet new On-board Refueling Vapor Recovery (ORVR) regulations in the U.S., it is necessary to minimize the resistance to vapor flow in an ORVR line during refueling. For example, this line resistance may be reduced by mounting a canister, which is usually installed within an engine compartment, adjacent a fuel tank to shorten the ORVR line extending between the fuel tank and the canister.

However, most areas or spaces around the fuel tank within which the canister can be mounted are usually of limited depth flat in cross section. Additionally, conventional canisters, as taught in Japanese Utility Model First Publication Nos. 62-20159 and 63-82062, are circular in cross section and difficult to install within the flat space. The installation of such canisters near the fuel tank requires reduction in sectional area of the canisters, but it will lead to a decrease in fuel vapor adsorbing area, resulting in a lowering of vapor-absorbing ability.

During refueling, a large amount of fuel vapor is usually discharged outside the vehicle. In order to avoid an excessive rise in pressure within the fuel tank during refueling, the loss of pressure of the fuel vapor flowing through the canister also needs to be low sufficiently. Further, there is an increasing need for increasing the density of adsorbent of the canister for capturing a large amount of fuel vapor.

SUMMARY OF THE INVENTION

It is therefore a principal object of the present invention to avoid the disadvantages of the prior art.

It is another object of the present invention to provide a canister for use in an evaporative emission control system for automotive vehicles which is easy to mount within a flat space without lowering the ability in adsorbing fuel vapors.

According to one aspect of the present invention, there is provided a canister for use in an evaporative emission control system which comprises: (a) a box-like casing having a first end wall and a second end wall opposite the first end wall; (b) an inlet port formed in the first end wall of the casing through which fuel vapors are drawn into the canister; and (c) a plurality of vapor-adsorbing passages each of which is filled with an adsorbing substance and has a given length through which the fuel vapors drawn from the inlet port flow, the vapor-adsorbing passages being defined within the casing in parallel to the flow of the fuel vapors.

In the preferred mode of the invention, the vapor-adsorbing passages are equal to each other in sectional area perpendicular to flow of the fuel vapors.

The casing includes a pair of opposed large side walls and a pair of opposed small side walls to define a rectangular cross section of the casing. The casing also has disposed therein at least one partition which defines the vapor-adsorbing passages. A purge port and an air inlet port are further provided. The purge port supplies the fuel vapors purged from the vapor-adsorbing passages to an intake air passage of an engine of an automotive vehicle. The air inlet port draws therethrough air to purge the fuel vapors adsorbed in the vapor-adsorbing passages. The purge port is formed in the first end wall of the casing. The air inlet port is formed in the second end wall of the casing.

A flow dividing plate is further disposed between the inlet port and the vapor-adsorbing passages for distributing the fuel vapors entering from the inlet port to the vapor-adsorbing passages to be uniform in flow rate. The flow dividing plate has formed therein openings each directing the fuel vapors to one of the vapor-adsorbing passages.

The flow dividing plate may have formed therein a first opening, a pair of second openings, and a third opening. The first opening directs part of the fuel vapors to first one of the vapor-adsorbing passage. The pair of second openings directs part of the fuel vapors to second one of the vapor-adsorbing passages arranged in alignment with the inlet port. The third opening directs the remainder of the fuel vapors to third one of the vapor-adsorbing passage. The pair of second openings are formed at a given interval away from each other across the inlet port.

The flow dividing plate also has formed therein a plurality of passages. The casing defines a first chamber and a second chamber between the first end wall and the flow dividing plate. The first chamber establishes fluid communication between the inlet port and the vapor-adsorbing passages through the openings of the flow dividing plate. The second chamber establishes fluid communication between the purge port and the vapor-adsorbing passages through the passages formed in the flow dividing plate.

Each of the passages formed in the flow dividing plates is defined by a cylindrical bore extending parallel to flow of the fuel vapors, communicating with one of the vapor-adsorbing passages.

Each of the vapor-adsorbing passages has a cross sectional area and a length L. If the cross sectional area is expressed as a diameter D, a ratio L/D is 1.8.

If a total area of the openings of the flow dividing plate is defined as S', a total area of cross sections of the vapor-adsorbing passages is defined as S, and a cross sectional area of the inlet port is defined as s, the following relation is satisfied:

$$1/5 \leqq S'/S \leqq (S-1.2s)/S$$

The distance between the vapor-adsorbing passages and the flow dividing plate is at least 2 mm.

A second flow dividing plate is further disposed between the air inlet and the vapor-adsorbing passages for distributing the air entering from the air inlet port to the vapor-adsorbing passages to be uniform in flow rate.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 2(*b*) is a horizontal cross sectional view of the canister in FIG. 2(*a*);

FIG. 5(*b*) is a bottom view as viewed from Vb in FIG. 5(*a*);

FIG. 5(*c*) is a cross sectional view taken along the line Vc—Vc in FIG. 5(*b*);

FIG. 6(*b*) is a vertical cross sectional view of the cover in FIG. 6(*a*);

FIG. 6(*c*) is a bottom view as viewed from VIc in FIG. 6(*b*);

FIG. 6(*d*) is a cross sectional view taken along the line A-B-C-D in FIG. 6(*a*);

FIG. 9(*b*) is an illustration as viewed from an arrow A in FIG. 9(*a*);

DESCRIPTION OF THE PREFERRED EMBODIMENT

Figure 1:
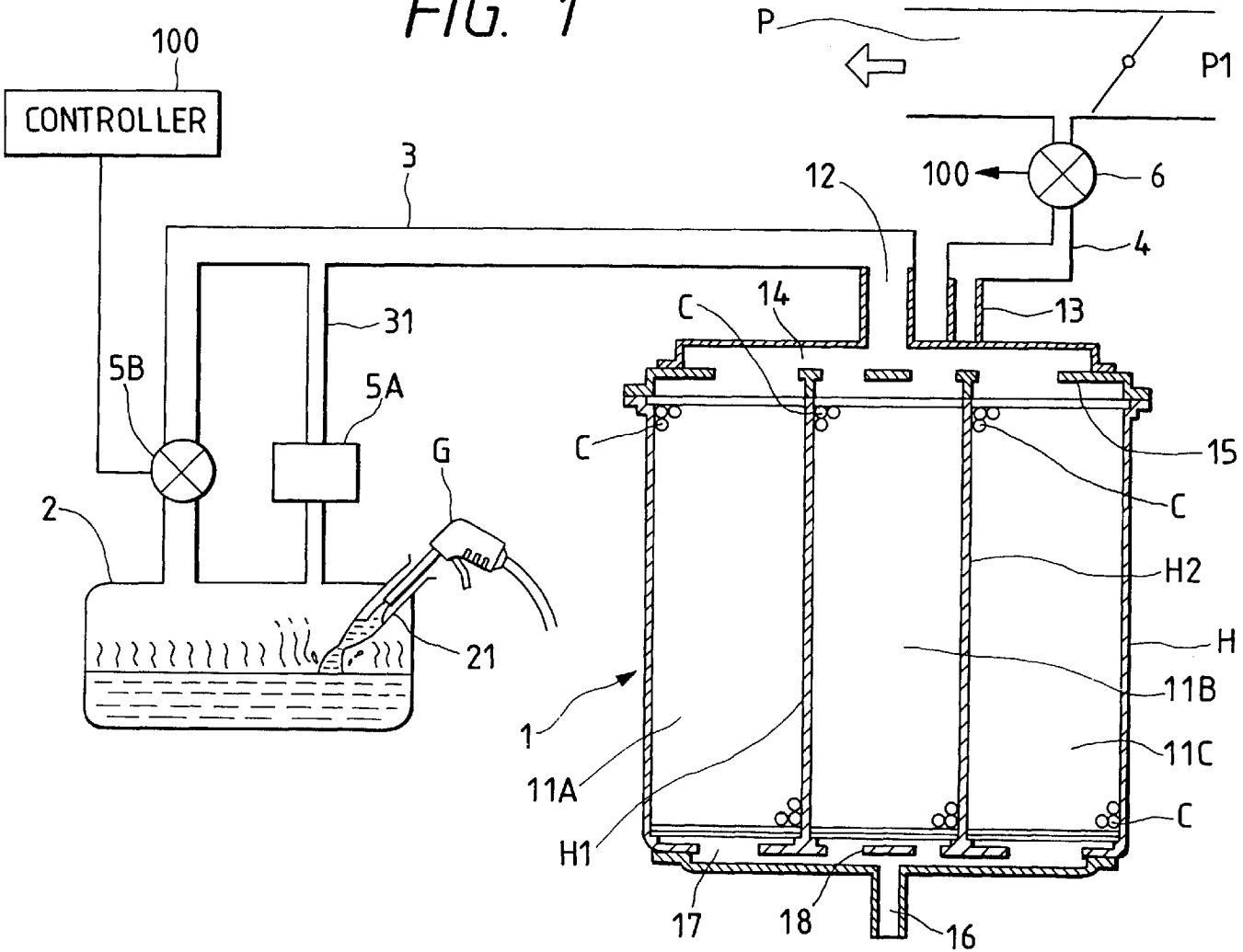
FIG. 1 is a cross sectional view which shows a canister mounted in an evaporative emission control system of an automotive vehicle.

Referring now to the drawings, particularly to FIG. 1, there is shown a fuel vapor collection canister 1 installed in an evaporative emission control system according to the invention.

The canister 1 is connected at an inlet port 12 to a fuel tank 2 through a first passage 3 (i.e., an ORVR line). The first passage 3 has disposed therein a solenoid valve 5B and connects with a branch passage 31 leading to the fuel tank 2. The branch passage 31 has disposed therein a tank pressure-activated valve 5A.

The canister 1 is also connected at a purge port 13 to a portion of an air intake passage P (i.e., an intake manifold) downstream of a throttle valve P1 through a second passage 4. The second passage 4 has disposed therein a solenoid valve 6. The inlet port 12 and the purge port 13 are formed in a cap or cover H5 of the canister 1 at a given interval away from each other in a direction perpendicular to the drawing.

The tank pressure-activated valve 5A has a dual valve structure. Specifically, when the temperature within the fuel tank 2 rises during parking so that the pressure within the fuel tank 2 is elevated to develop a difference in internal pressure between the fuel tank 2 and the canister 1 above a given level, it will cause the tank pressure-activated valve 5A to be opened, thereby allowing fuel vapors generated in the fuel tank 2 to be drawn into the canister 1 and collected therein. Conversely, when the tank temperature is lowered so that the tank pressure is decreased to develop the difference in internal pressure between the fuel tank 2 and the canister 1 above the given level, it will cause the tank pressure-activated valve 5A to be also opened so that the fuel vapors collected in the canister 1 are drawn back to the fuel tank 2. While the fuel tank 2 is refueled by a filler gun G, the solenoid valve 5B is opened by a controller 100 so that a large amount of fuel vapors flow into the canister 1 through the first passage 3 so that they are captured therein. Upon starting of the engine, the solenoid valve 6 is opened by the controller 100 so that the fuel vapors captured in the canister 1 are drawn into the air intake passage P by a negative pressure thereof.

Figure 2A:
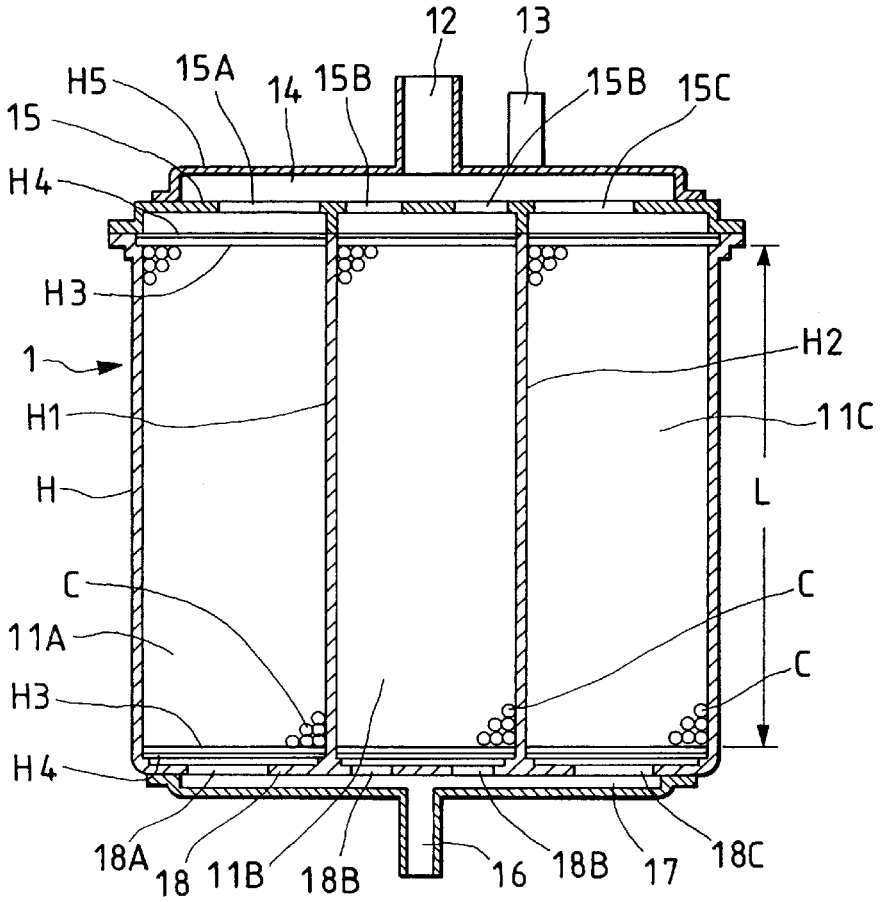
FIG. 2(*a*) is a vertical cross sectional view of a canister.
Figure 2B:
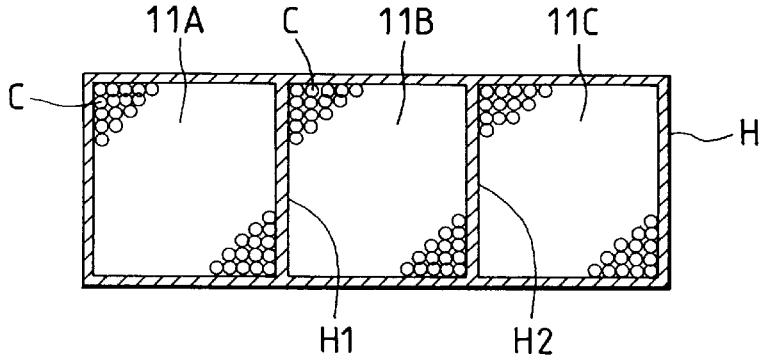

FIGS. 2(*a*) and 2(*b*) show the structure of the canister 1.

The canister 1 includes a box-like casing H having a rectangular cross section and partitions H1 and H2. The partitions H1 and H2 extend longitudinally of the casing H to define three chambers which are equal in shape and volume. These chambers are filled with activated carbon C and define three vapor-adsorbing passages 11A to 11C having the same length L extending parallel to the vapor flow. Each of the vapor-adsorbing passages 11A to 11C has disposed at both ends thereof filters H3 and porous plates H4 and stores the activated carbon C therebetween.

Figure 3:
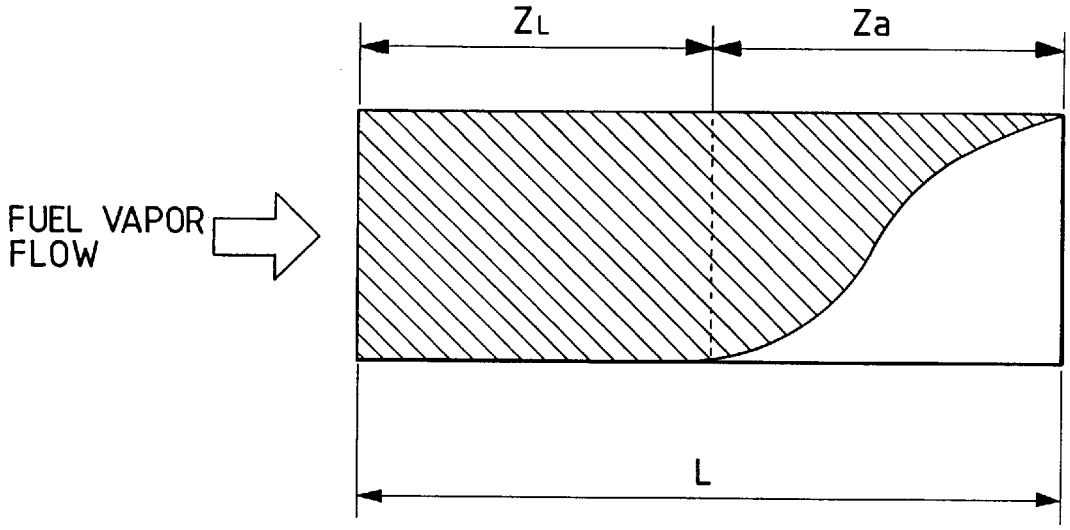
FIG. 3 is an illustration which shows the relation between the length L of each of vapor-adsorbing passages and the density of adsorbed fuel vapor.

FIG. 3 shows the relation between the length L of each of the vapor-adsorbing passages 11A to 11C and the density of adsorbed fuel vapors qe (indicated by a hatched area). ZL indicates a vapor-saturated area within which the fuel vapors are adsorbed by the activated carbon C with a vapor-saturated density q0. Za indicates a vapor-adsorbed area whose vapor-adsorbed density qe is gradually decreased as approaching an outlet. Specifically, in the Za area, an average vapor-adsorbed density is qe/2. In the drawing, the top (i.e., a breakpoint) of the vapor-adsorbed area Za of each of the vapor-adsorbing passages 11A to 11C reaches the outlet thereof. This means that a more increase in fuel vapor results in leakage thereof from each of the vapor-adsorbing passages 11A to 11C without being adsorbed (generally called breakthrough).

The vapor-adsorbed density qe at the breakpoint of each of the vapor-adsorbing passages 11A to 11C may be expressed by the equation (1) below.

$$qe=q0(1-1/2\cdot Za/L) \quad (1)$$

The equation (1) shows that increasing the vapor-adsorbed density qe requires shortening the vapor-adsorbed area Za or increasing the length L of each of the vapor-adsorbing passages 11A to 11C.

Figure 4:
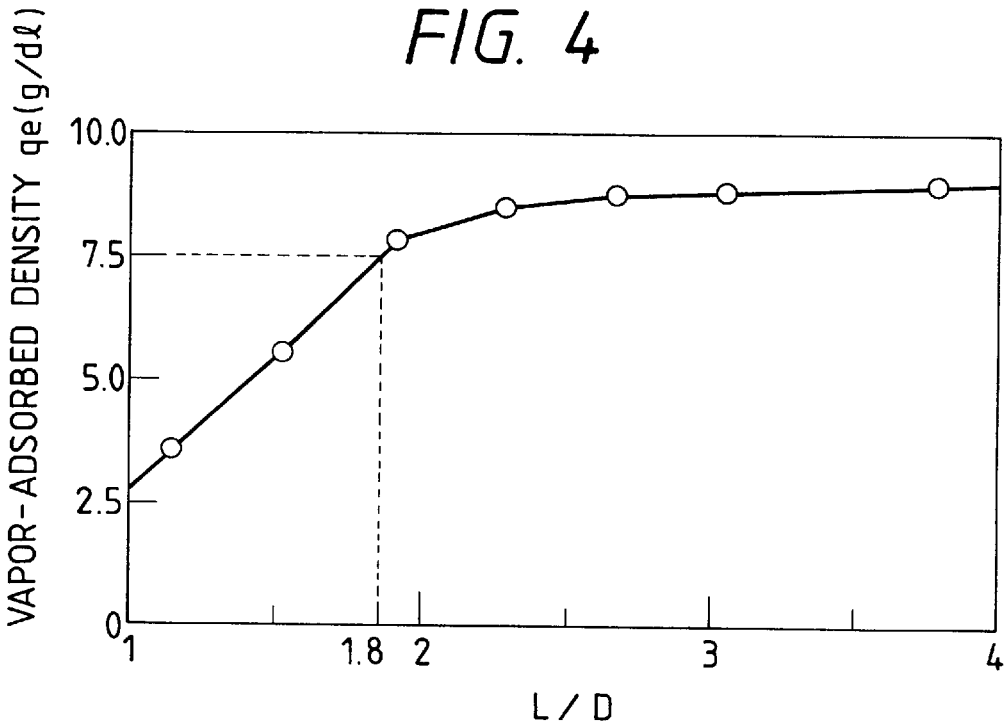
FIG. 4 is a graph which shows test results of the relation between the vapor-adsorbed density and the ratio L/D of length L to a cross sectional area of each vapor-adsorbing passage as defined as diameter D.

FIG. 4 shows test results for the relation between the vapor-adsorbed density qe and a ratio L/D of the length L to a sectional area of each of the vapor-adsorbing passages 11A to 11C as defined as diameter D. The test results show that as the passage length L is increased as compared with the passage diameter D, the vapor-adsorbed density qe is increased and assumes near saturation when the ratio L/D is above 1.8. It is thus advisable that the ratio L/D of the length L to the diameter D of each of the vapor-adsorbing passages 11A to 11C be above 1.8 to maximize the vapor-adsorbed density qe.

Referring back to FIGS. 2(*a*) and 2(*b*), the canister 1 has formed in a central portion of the cover H5 the inlet port 12 communicating with the first passage 3. The inlet port 12 may be replaced with three inlet ports each communicating with one of the vapor-adsorbing passages 11A to 11C.

The use of the single inlet port 12 common to the three vapor-adsorbing passages 11A to 11C may, however, cause most vapor flow only to enter the vapor-adsorbing passage 11B extending immediately downstream of the inlet port 12. In order to avoid this problem, a vapor passage 14 is formed between the inlet port 12 and the three vapor-adsorbing passages 11A to 11C, and a flow dividing plate 15 is disposed within the vapor passage 14 perpendicular to the inlet port 12 to divide the vapor flow from the inlet port 12 equally among the three vapor-adsorbing passages 11A to 11C.

Figure 5A:
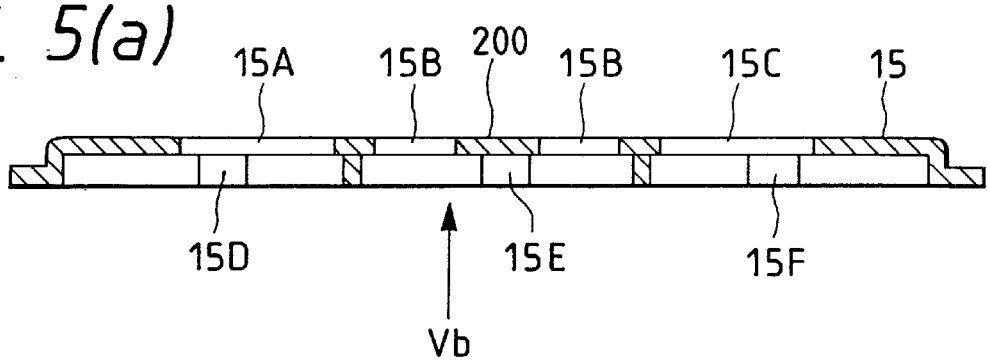
FIG. 5(*a*) is a cross sectional view which shows a flow dividing plate distributing fuel vapors equally to vapor-adsorbing passages.
Figure 5B:
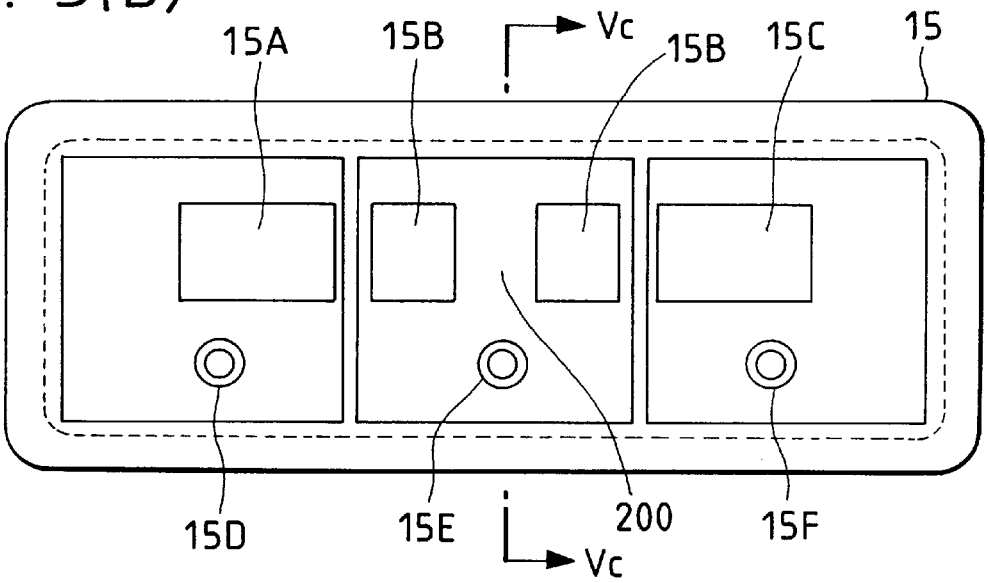
Figure 5C:
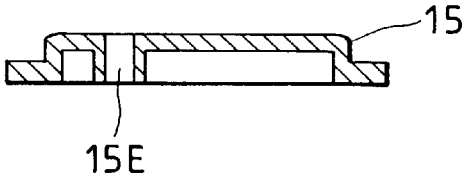
Figure 6A:
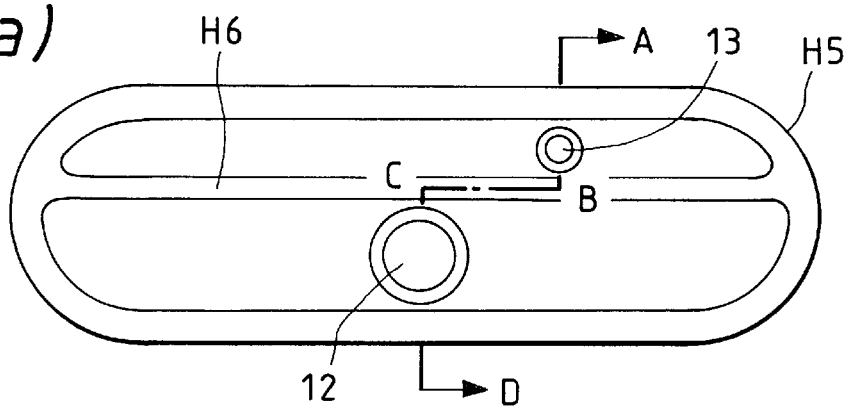
FIG. 6(*a*) is a plan view which shows a cover of a canister.
Figure 6B:
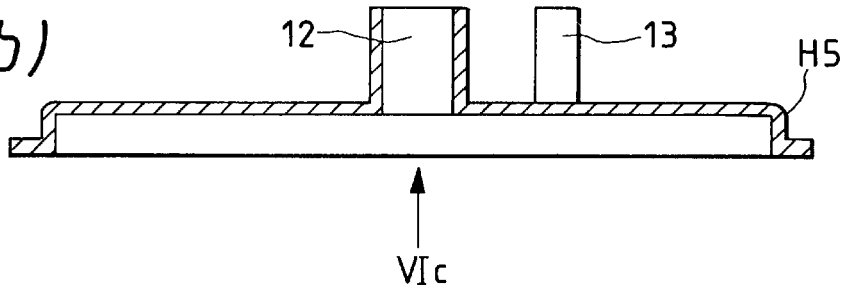
Figure 6C:
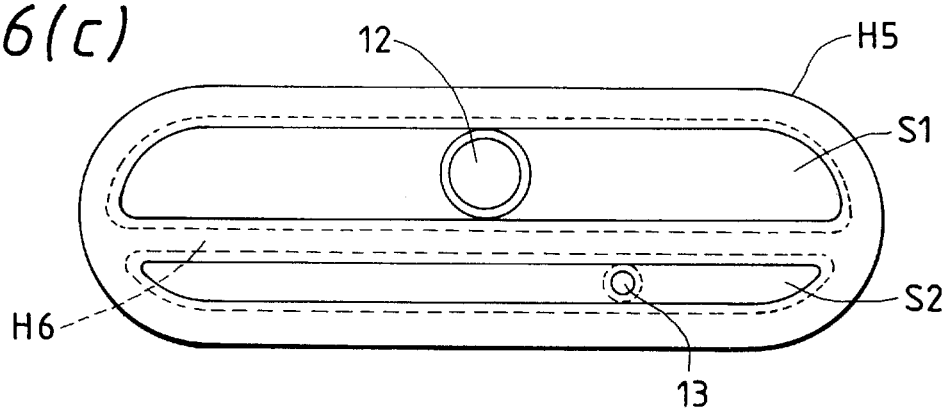
Figure 6D:
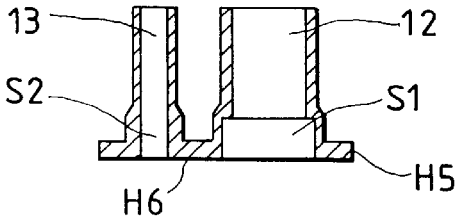

FIGS. 5(*a*) to 5(*c*) show the structure of the flow dividing plate 15.

The flow dividing plate 15 has formed therein openings 15A, 15B, and 15C. The opening 15A, as can be seen from FIG. 2, communicates with the vapor-adsorbing passage 11A. The pair of openings 15B communicate with the vapor-adsorbing passage 11B. The opening 15C communicates with the vapor-adsorbing passage 11C. All the openings 15A to 15C are, as clearly shown in FIG. 5(*b*), shifted slightly to an upper side wall, as viewed in the drawing, from the longitudinal center line so that they are aligned with the vapor flow from the inlet port 12. The openings 15B are formed away from each other through a block wall portion 200 which is located immediately downstream of the inlet port 12 for preventing the vapor flow from the inlet port 12 from directly entering the vapor-adsorbing passage 11B. Specifically, the openings 15A to 15C are formed so as to divide the vapor flow from the inlet port 12 to be uniform in flow rate among the three vapor-adsorbing passages 11A to 11C. The shape, total number, size, and location of the openings 15A to 15C are not limited, but a total area of the openings 15B is preferably equal to those of the openings 15A and 15C.

The flow dividing plate 15 also has formed therein three cylindrical bores 15D, 15E, and 15F. The bores 15D to 15F, as clearly shown in FIGS. 5(*a*) and 5(*c*), extend parallel to the flow of the fuel vapors and establish fluid communication between the purge port 13 and the vapor-adsorbing passages 11A to 11C, respectively. The bores 15D to 15F have the same cross-sectional area, and a total cross-sectional area thereof is greater than a cross-sectional area of the purge port 13.

FIGS. 6(*a*) to 6(*d*) show the structure of the cover H5 of the canister 1.

The cover H5 has separate chambers S1 and S2, as shown in FIG. 6(*c*), defined by a partition H6. The chamber S1 defines the vapor passage 14, as shown in FIG. 2(*a*), communicating with the inlet port 12 and faces the openings 15A to 15C of the flow dividing plate 15. The chamber S2 communicates with the purge port 13 and faces the bores 15D to 15F of the flow dividing plate 15.

Specifically, fuel vapors evaporated within the fuel tank 2 first enter the chamber S1 (i.e., the vapor passage 14) from the inlet port 12 and disperse therein. The fuel vapors dispersed in the chamber S1 are divided by the flow dividing plate 15 into a plurality of vapor flows and then dispersed again between the flow dividing plate 15 and the vapor-adsorbing passages 11A to 11C, after which they flow into the vapor-adsorbing passages 11A to 11C. When the fuel vapors are purged from the canister 1, they are discharged from the vapor-adsorbing passages 11A to 11C to the purge port 13 through the chamber S2. This prevents the fuel vapors evaporated in the fuel tank 2 from being drawn directly into the purge port 13, thereby avoiding a shift in air-fuel ratio due to direct suction of the fuel vapors into the air intake passage P.

Figure 7:
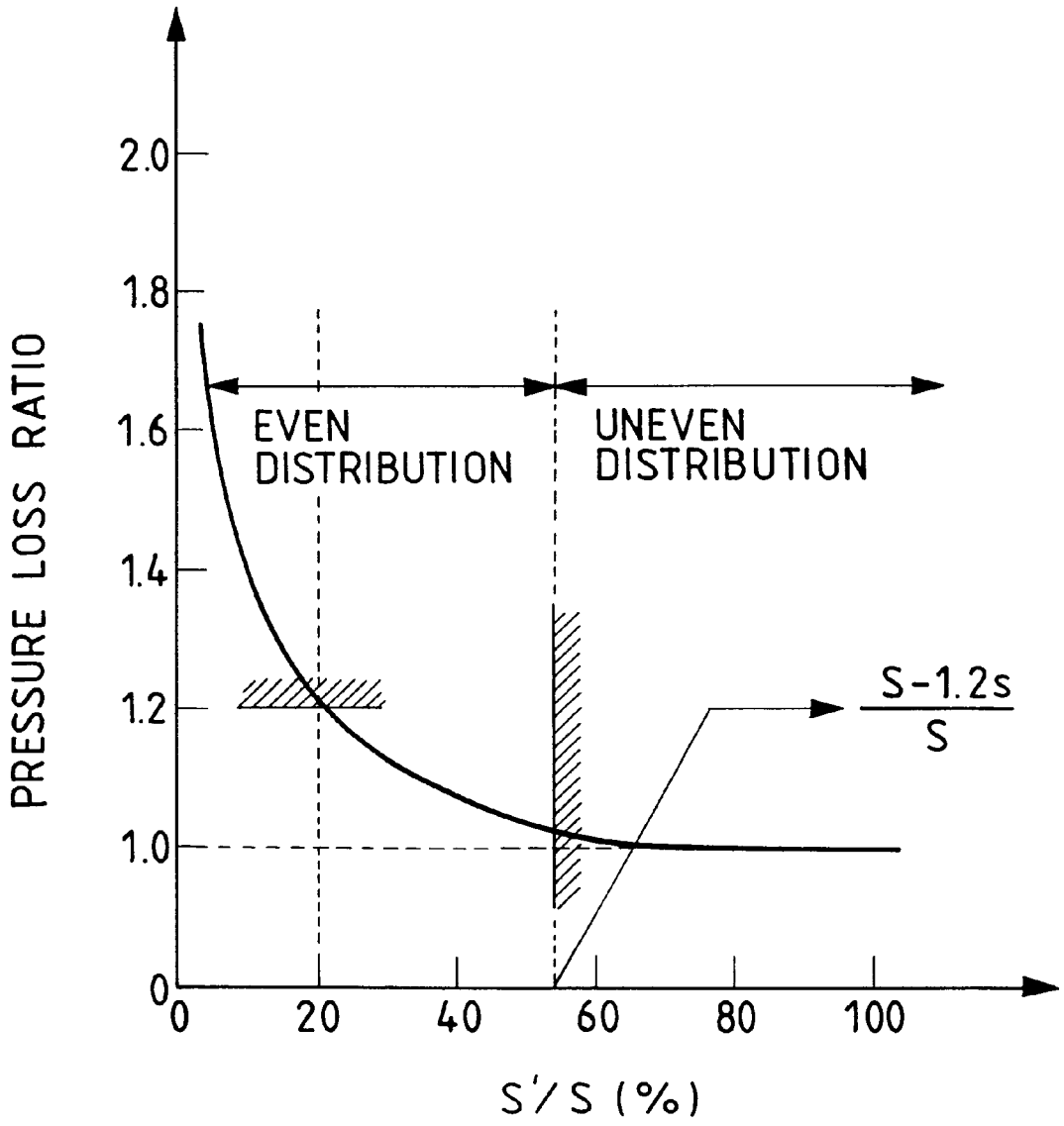
FIG. 7 shows the relation between the ratio S'/S of a total area of openings of a flow dividing plate to a total sectional area of vapor-adsorbing passages and a pressure loss ratio of the openings to the vapor-adsorbing passages.

When a total area S' of the openings 15A to 15C is 1/5 or more times a total sectional area S of the vapor-adsorbing passages 11A to 11C, it becomes possible to distribute the fuel vapors equally among the vapor-adsorbing passages 11A to 11C with a small loss of flow pressure of the fuel vapors. FIG. 7 shows the relation between the ratio S'/S of the total area of the openings 15A to 15C to the total sectional area of the vapor-adsorbing passages 11A to 11C and a pressure loss ratio of the openings 15A to 15C to the vapor-adsorbing passages 11A to 11C. As clearly shown in FIG. 7, the pressure loss ratio becomes less than 1.2 when the ratio S'/S is 20% (i.e., 1/5). However, when the ratio S'/S is too great, it becomes difficult to distribute the fuel vapors equally among the vapor-adsorbing passages 11A to 11C. It is thus advisable that the ratio S'/S be determined according to the equation below.

$$1/5 \leqq S'/S \leqq (S-1.2s)/S \quad (2)$$

where s is an area of the inlet port 12.

Figure 8:
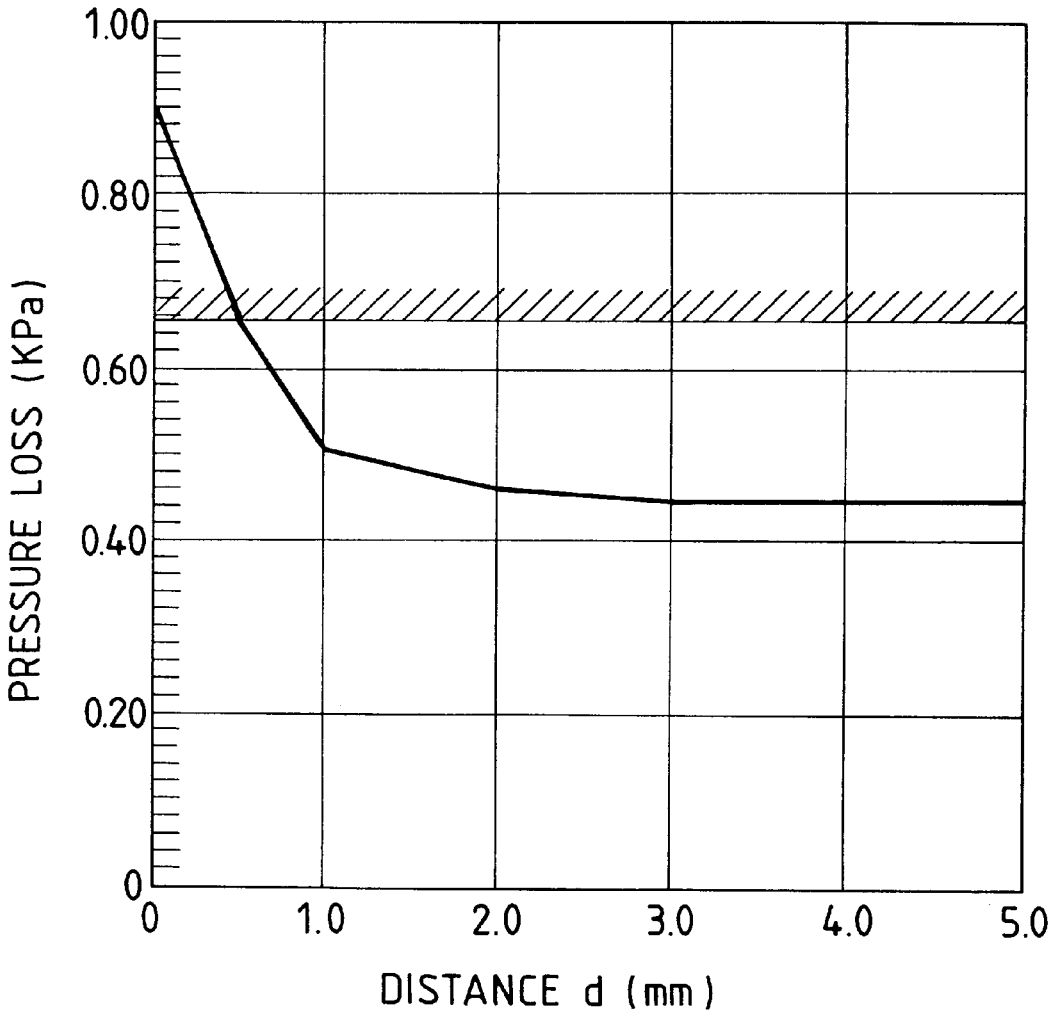
FIG. 8 is a graph which shows the relation of the pressure loss of vapor flow and the distance between a flow dividing plate and vapor-adsorbing passages.

It is also preferable that the space be formed between the flow dividing plate 15 and the vapor-adsorbing passages 11A to 11C for dispersing the fuel vapors entering from the openings 15A to 15C. When the distance d between the flow dividing plate 15 and the vapor-adsorbing passages 11A to 11C is 2 mm or more, it becomes possible to decrease a pressure loss below about 50% as shown in FIG. 8. This also allows the fuel vapors to flow into the vapor-adsorbing passages 11A to 11C uniformly, thereby resulting in greatly improved vapor adsorption efficiency.

Referring back to FIG. 2(*a*), the casing H has formed in a central portion of the bottom thereof an air inlet port 16 exposed to the atmosphere. The inlet port 16 introduces fresh air into the vapor-adsorbing passages 11A to 11C through a chamber 17 and a flow dividing plate 18.

The flow dividing plate 18 has substantially the same structure as that of the flow dividing plate 15. Specifically, the flow dividing plate 18 has formed therein openings 18A, 18B, and 18C communicating with the vapor-adsorbing passages 11A to 11C. The two openings 18B are shifted horizontally, as viewed in the drawing, across the air inlet port 16 for preventing the air from being drawn directly into the vapor-adsorbing passage 11B. The shape, total number, size, and location of the openings 18A to 18C are not limited, but a total area of the openings 18B is preferably equal to those of the openings 18A and 18C.

Like the flow dividing plate 15, It is advisable that the ratio of the total area S' of the openings 18A to 18C to the total sectional area S of the vapor-adsorbing passages 11A to 11C meet the relation of $1/5 \leqq S'/S \leqq (S-1.2s)/S$.

Figure 9A:
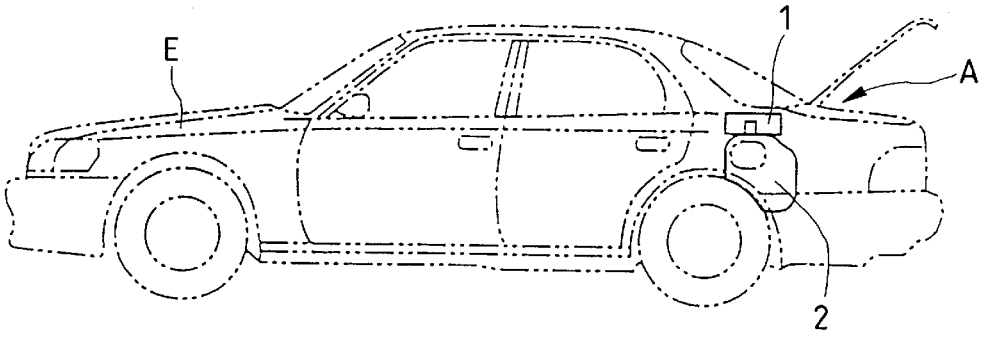
FIG. 9(*a*) is an illustration which shows an automotive vehicle equipped with a canister of the invention.
Figure 9B:
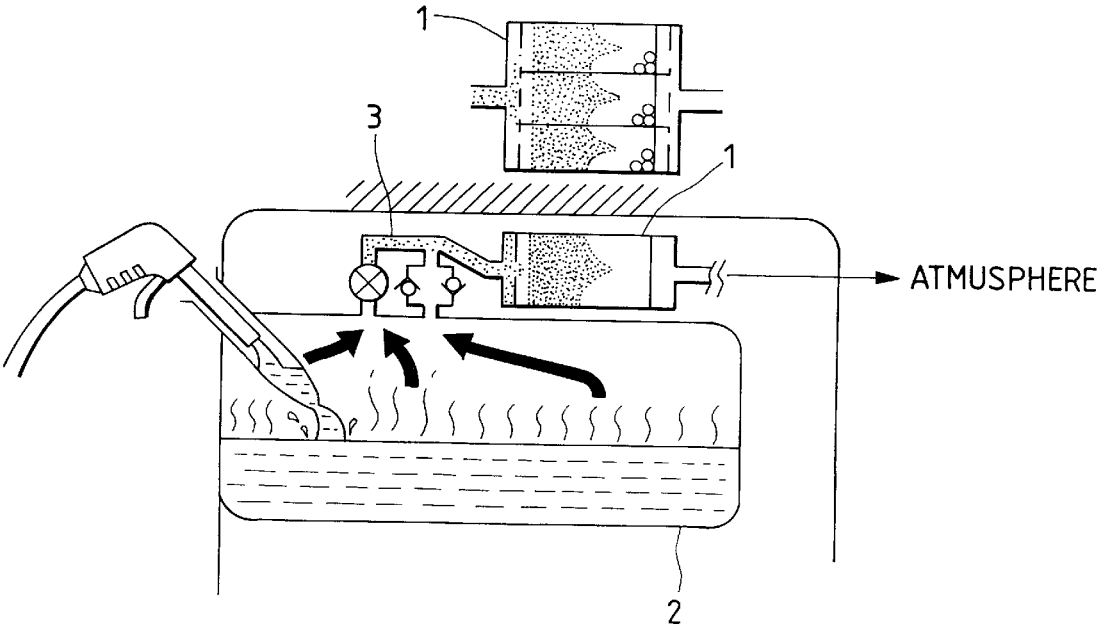

The canister 1 has, as can be seen from the drawings, a flat shape or is rectangular in cross section and thus can be mounted, as shown in FIGS. 9(*a*) and 9(*b*), within a flat space above the fuel tank 2. This allows the first passage 3 extending between the fuel tank 2 and the canister 1 to be shortened as compared with conventional evaporative emission control systems having a canister mounted within an engine compartment, thereby resulting in a decrease in flow resistance in the first passage 3 (i.e., the ORVR line).

As described above, the advantages of parallel arrangement of the vapor-adsorbing passages 11A to 11C will be discussed below.

Figure 10:
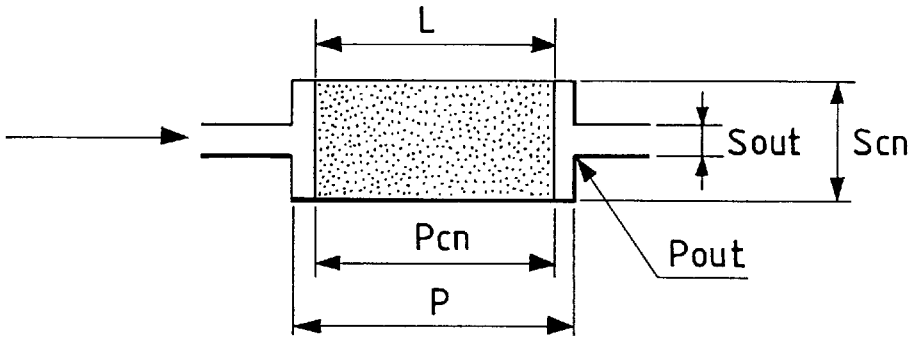
FIG. 10 is a schematic cross sectional view which shows a canister.

The ORVR regulations require liquid sealing during refueling. The liquid sealing is, as shown in FIG. 1, established by part of fuel staying at a tapered portion of a filler tube 21, thereby preventing fuel vapors from escaping out of the fuel tank 2 through the filler tube 21. If the canister 1 causes a great pressure loss of vapor flow, it will cause the pressure within the fuel tank 2 to rise undesirably, which may result in failure in refueling. In order to avoid this drawback, it is necessary to decrease the pressure loss (ΔP) of vapor flow passing through the canister 1 which may be generally expressed by the equation (3) below. The equation (3) shows that a decrease in pressure loss ΔP requires a great increase in total area S of the vapor-adsorbing passages 11A to 11C. However, an increase in vapor-adsorbed density qe requires, as discussed above, the ratio L/D of the length L to the diameter D of each of the vapor-adsorbing passages 11A to 11C greater than 1.8. Specifically, it is advisable that the diameter D of the vapor-adsorbing passages 11A to 11C be as small as possible. This trade-off is objectionable in conventional evaporative emission control systems.

$$\Delta P = Pcn + Pout = K1/\{(Scn \cdot N)^2 \cdot Dp\} \times L + K2 \times (1/Sout - 1/Scn)^2/Sout \cdot N) \quad (3)$$

where Pcn is, as shown in FIG. 10, the pressure loss of vapor flow caused by passage through portions filled with activated carbon or vapor-adsorbing passages, Scn is the sectional area ($m^2$) of the vapor-adsorbing passages, Pout is the pressure loss of the vapor flow caused by passage through an outlet port, Sout is the sectional area of the outlet port, N is the number of the vapor-adsorbing passages, Dp is the average particle diameter of the activated carbon (m), L is the length of the vapor-absorbing passages, and K1 and K2 are constants.

Figure 11:
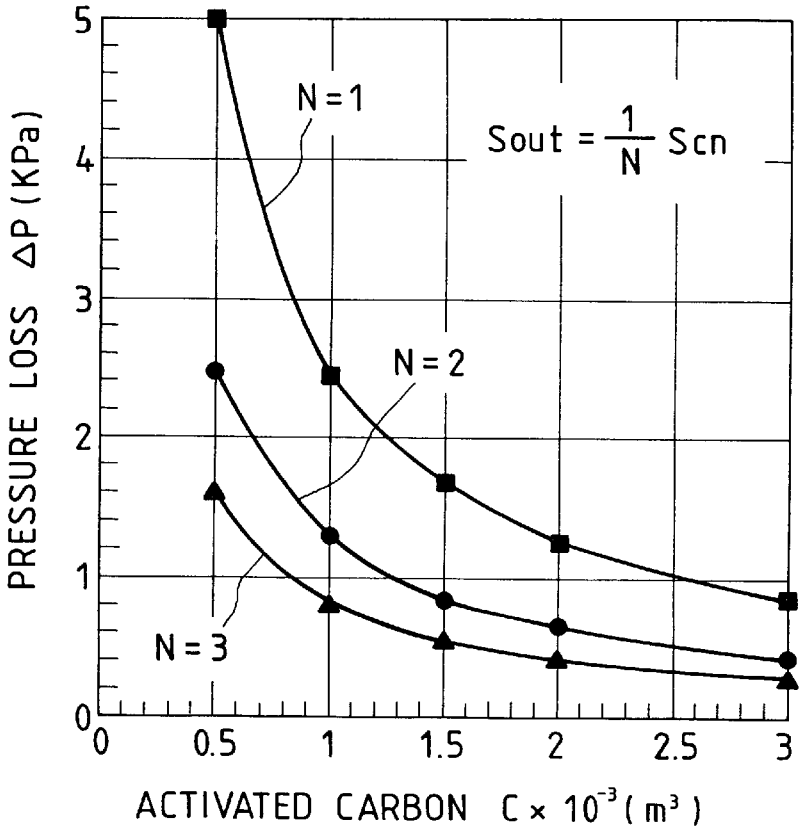
FIG. 11 is a graph which shows the relations between the pressure loss ΔP of vapor flow and the quantity of activated carbon C in terms of the number of vapor-adsorbing passages N.

In order to avoid the above trade-off problem, the canister 1 of this invention has the three vapor-adsorbing passages 11A to 11C disposed parallel to each other. The relations between the pressure loss ΔP and the quantity of activated carbon C in terms of the number of vapor-adsorbing passages N are shown in a graph of FIG. 11. The graph shows that the pressure loss ΔP is reduced regardless of the quantity of activated carbon C as the number of vapor-adsorbing passages N is increased and that a great reduction in pressure loss ΔP appears, especially in a range where the quantity of activated carbon C is small. Specifically, a canister having a single vapor-adsorbing passage is difficult to decrease the volume thereof for the pressure loss of vapor flow, but both the decrease in volume of the canister and reduction in pressure loss may be achieved by forming a plurality of vapor-adsorbing passages in the canister.

Figure 12:
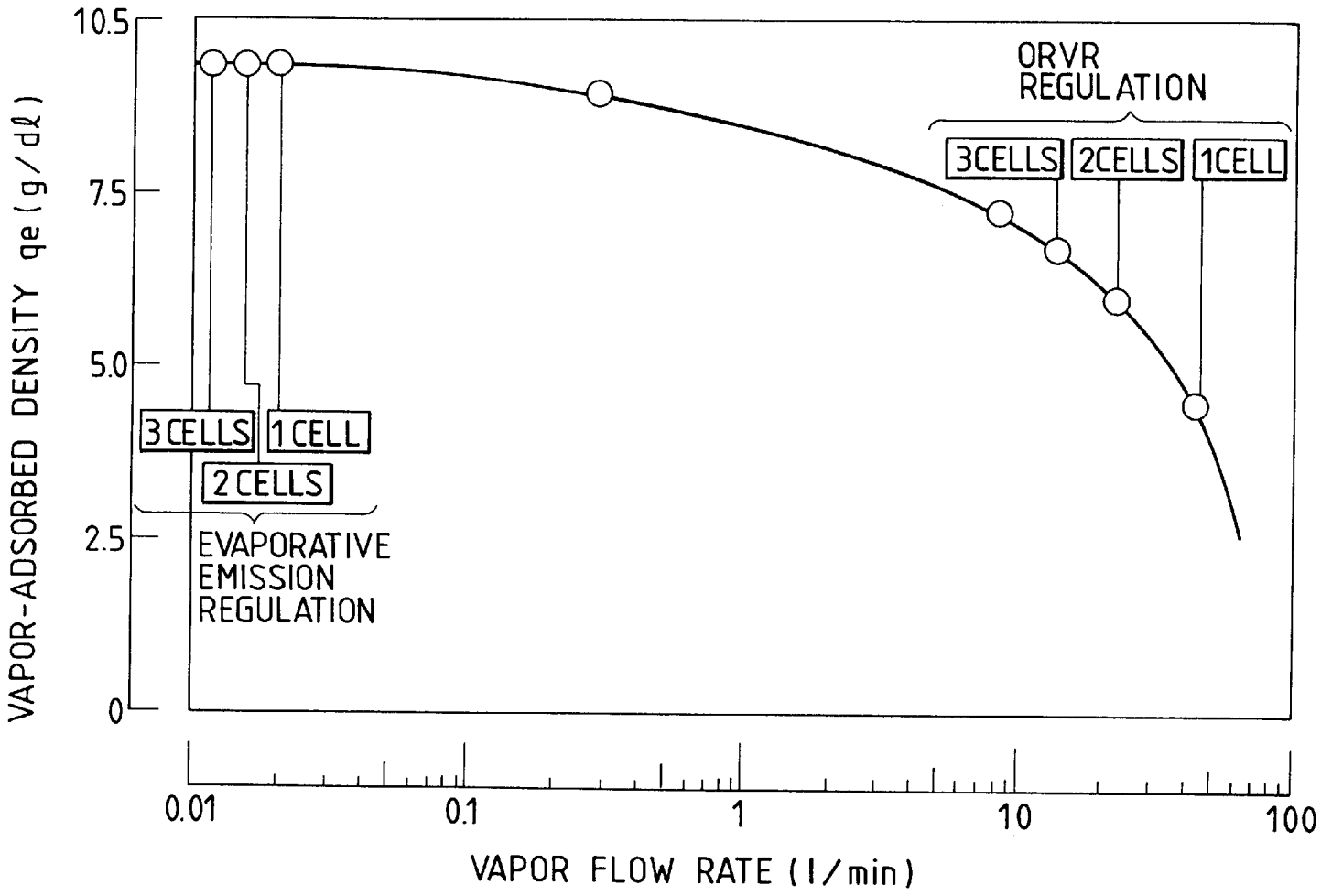
FIG. 12 is a graph which shows the relation between the flow rate of fuel vapor and the vapor-adsorbed density.

FIG. 12 shows the relation between the flow rate of fuel vapor and the vapor-adsorbed density qe. This relation shows that when the flow rate of fuel vapor is small, the vapor-adsorbed density qe is constant regardless of the number of vapor-adsorbing passages (as indicated as the number of cells in the drawing), which meets the conventional evaporative emission control regulations, however, the vapor-adsorbed density qe is decreased as the flow rate of fuel vapor is increased. Particularly, the vapor-adsorbed density qe is greatly decreased in a canister having a single vapor-adsorbing passage. The greater the number of vapor-adsorbing passages defined in a canister, the smaller the flow rate of fuel vapor flowing through each of the vapor-adsorbing passages. This results in a great increase in vapor-adsorbed density. Accordingly, both the increase in vapor-adsorbed density and reduction in pressure loss are achieved which meet the ORVR regulations.

The flow dividing plate 15 is, as described above, disposed between the inlet port 12 and the vapor-adsorbing passages 11A to 11C to distribute fuel vapors, which are drawn from the inlet port 12 and dispersed within the vapor passage 14, equally by the openings 15A to 15C. These vapor flows which have passed through the openings 15A to 15C are dispersed again and enter the vapor-adsorbing passages 11A to 11C to be uniform in flow rate. This allows the fuel vapors to be distributed equally to the vapor-adsorbing passages 11A to 11C without concentrating at part of the activated carbon, thereby resulting in a greatly improved vapor-adsorbing efficiency. The pressure loss of vapor flow is minimized by bring an sectional area ratio of the openings 15A to 15C to the vapor-adsorbing passages 11A to 11C within a given range and setting an interval between the flow dividing plate 15 and the vapor-adsorbing passages 11A to 11C greater than a given value.

Figure 13:
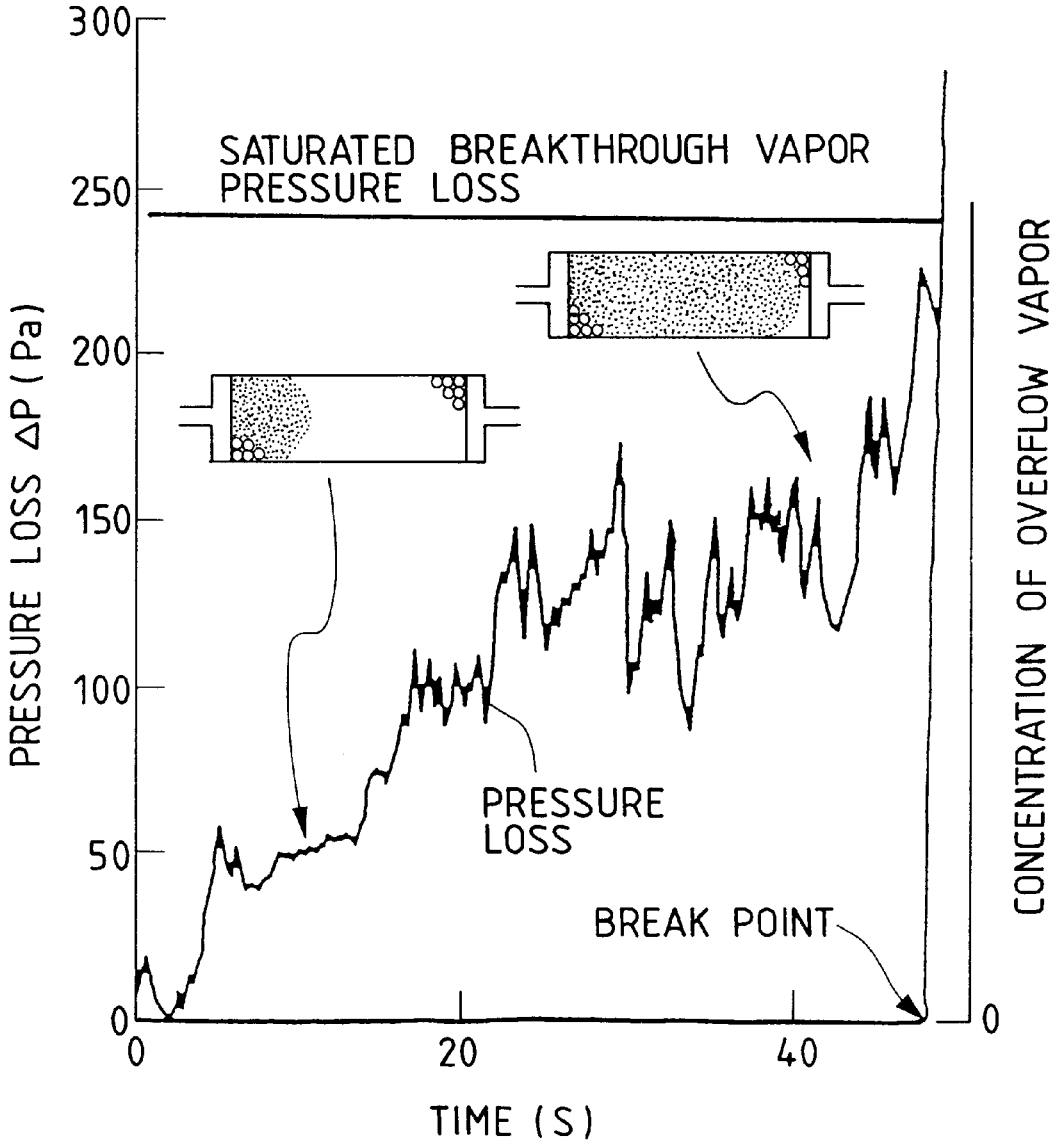
FIG. 13 is a graph which shows a variation in pressure loss of vapor flow passing through vapor-adsorbing passages.

The inlet port 12, the air inlet port 16, the vapor passage 14, and the chamber 17 hardly cause the pressure loss of vapor flow. Specifically, the pressure loss of vapor flow depends upon the vapor-adsorbing passages 11A to 11C. The vapor-adsorbing passages 11A to 11C have the same geometry and thus induce substantially the same pressure loss of vapor flow. The pressure loss of vapor flow in the canister 1 is, as shown in FIG. 13, increased as an adsorbed amount of fuel vapors is increased. Specifically, even if there is a small difference in pressure loss of vapor flow between the vapor-adsorbing passages 11A to 11C, and a large amount of fuel vapors flow into one of the vapor-adsorbing passages 11A to 11C showing the smallest pressure loss, all the vapor-adsorbing passages 11A to 11C will show the same pressure loss of vapor flow when a certain adsorbed amount of fuel vapors is reached, after which the fuel vapors are drawn into the vapor-adsorbing passages 11A to 11C uniformly.

The same is true of release of the fuel vapors from the activated carbon. Specifically, when the fuel vapors adsorbed in the canister 1 are purged by the air, it will cause the amount of the fuel vapors flowing through the vapor-adsorbing passages 11A to 11C to be increased, resulting in an increase in pressure loss of the vapor flow. Thus, even if there is a difference in pressure loss of vapor flow between the vapor-adsorbing passages 11A to 11C, and a large amount of air is drawn into one of the vapor-adsorbing passages 11A to 11C showing the smallest pressure loss, the pressure losses of vapor flows through the vapor-adsorbing passages 11A to 11C reach the same level in time so that the air is distributed equally among the vapor-adsorbing passages 11A to 11C, thereby allowing the fuel vapors to be purged equally from the vapor-adsorbing passages 11A to 11C.

Figure 14:
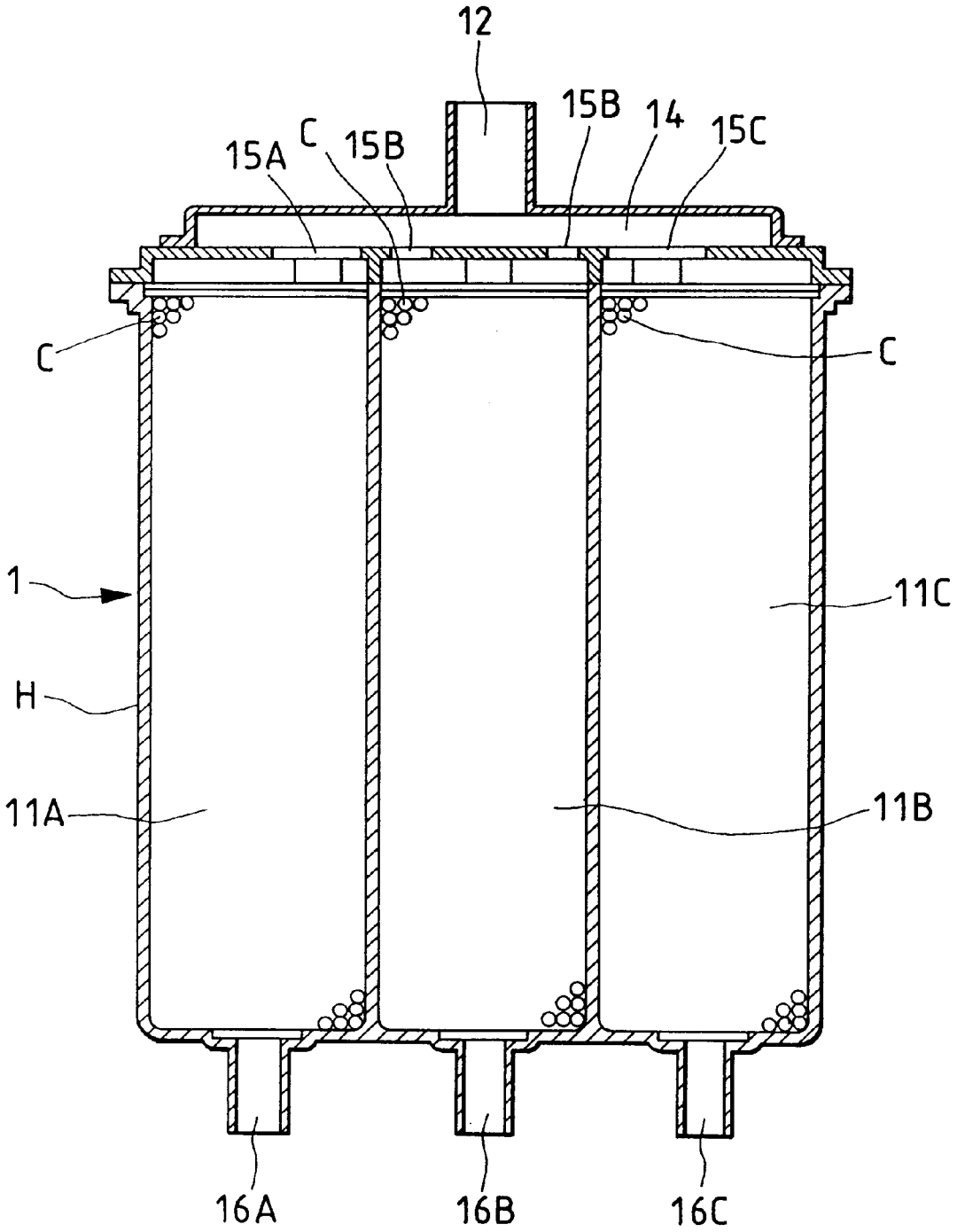
FIG. 14 is a cross sectional view which shows a modification of a canister.

FIG. 14 shows a modification of the canister 1 which includes three air inlet ports 16A, 16B, and 16C, one for each of the vapor-adsorbing passages 11A to 11C. Sectional areas of the air inlet ports 16A to 16C are equal to each other and are 1/5 or more times sectional areas of the vapor-adsorbing passages 11A to 11C.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A canister for use in an evaporative emission control system comprising:

a box-like casing having a first end wall and a second end wall opposite the first end wall, said casing also having a pair of opposed large side walls and a pair of opposed small side walls defining a rectangular cross section of said casing, also having disposed therein at least on partition;

an inlet port formed in the first end wall of said casing through which fuel vapors are drawn into the canister;

a plurality of vapor-absorbing passages defined by the partition within said casing each of which is filled with an absorbing substance and has a given length through which the fuel vapors drawn from said inlet port flow, said vapor-adsorbing passages being defined within said casing in parallel to flow of the fuel vapors;

a purge port for supplying the fuel vapors purged from said vapor-adsorbing passages to an intake air passage of an engine of an automotive vehicle, said purge port being formed in the first end wall of said casing;

an air inlet port through which air is drawn to purge the fuel vapors adsorbed in said vapor-adsorbing passages, said air inlet port being formed in the second end wall of said casing; and a flow dividing member which is disposed between the inlet port and said vapor-adsorbing passages and which divides and distributes the flow of the fuel vapors entering at said inlet port to be uniform in flow rate to said vapor-adsorbing passages.

2. A canister as set forth in claim 1, wherein said vapor-adsorbing passages are equal to each other in sectional areas perpendicular to flow of the fuel vapors.

3. A canister as set forth in claim 1 wherein said flow dividing member includes a flow dividing plate having formed therein a plurality of openings which communicate with said vapor-absorbing passages, respectively, each of the openings having substantially the same area.

4. A canister as set forth in claim 1, wherein said flow dividing member has formed therein a first opening, a pair of second openings, and a third opening, the first opening directing part of the fuel vapors to a first one of said vapor-adsorbing passages, the pair of second openings directing part of the fuel vapors to a second one of vapor-absorbing passages arranged in alignment with said inlet port, the third opening directing the remainder of the fuel vapors to a third one of said vapor-adsorbing passages, the pair of second openings being formed at a given interval away from each other across said inlet port.

5. A canister as set forth in claim 1, further comprising a second flow dividing member disposed between said air inlet and said vapor-adsorbing passages for distributing the air entering from said air inlet port to said vapor-adsorbing passages to be uniform in flow rate.

6. A canister as set forth in claim 1, wherein said flow dividing member has formed therein a plurality of passages, and a plurality of openings, each of said openings directing the fuel vapors to one of said vapor-adsorbing passages, said casing defining a first chamber and a second chamber between the first end wall and said flow dividing member, the first chamber establishing fluid communication between said inlet port and said vapor-adsorbing passages through said openings of said flow dividing member, the second chamber establishing fluid communication between the purge port and said vapor-adsorbing passages through said passages formed in said flow dividing member.

7. A canister as set forth in claim 6, wherein each of the passages formed in said flow dividing member is defined by a cylindrical bore extending parallel to flow of the fuel vapors, communicating with one of said vapor-adsorbing passages.

8. A canister as set forth in claim 1, wherein each of said vapor-adsorbing passages has a cross sectional area and a length L, if the cross sectional area is expressed as a diameter D, a ratio L/D being 1.8.

9. A canister as set forth in claim 1, wherein flow dividing member has formed therein openings directing the fuel vapors to one of said vapor-adsorbing passages, and wherein if a total area of the openings of said flow dividing plate is defined as S', a total area of cross sections of said vapor-adsorbing passages is defined as S, and a cross sectional area of said inlet port is defined as s, the following relation is satisfied:

$$1/5 \leqq S'/S \leqq (S-1.2s)/S$$

10. A canister as set forth in claim 1, wherein said vapor-adsorbing passages and said flow dividing member are spaced apart by a distance of at least two mm.

11. A canister for use in an evaporative emission control system comprising:

a box-like casing having a first end wall and a second end wall opposite the first end wall;

an inlet port formed in the first end wall of said casing through which fuel vapors are drawn into the canister;

a plurality of vapor-adsorbing passages each of which is filled with an adsorbing substance and has a given length through which the fuel vapors drawn from said inlet port flow, said vapor-adsorbing passages being defined within said casing in parallel to flow of the fuel vapors; and a flow dividing plate disposed between said inlet port and said vapor-adsorbing passages for distributing the fuel vapors entering at said inlet port to be uniform in flow rate to said vapor-adsorbing passages.

12. A canister for use in an evaporative emission control system comprising:

a box-like casing having a first end wall and a second end wall opposite the first end wall:

an inlet port formed in the first end wall of said casing through which fuel vapors are drawn into the canister;

a flow dividing plate disposed between said inlet port and the vapor-adsorbing passages for distributing the fuel vapors entering from the said inlet port to be uniform in flow rate to said vapor-adsorbing passages; and said flow dividing plate having formed therein a first opening, a pair of second openings, and a third opening, the first opening part of the fuel vapors to a first one of said vapor-adsorbing passages, a pair of second openings directing part of the fuel vapors to a second one of said vapor-adsorbing passages arranged in alignment with said inlet port, the third opening directing the remainder of the fuel vapors to a third one of said vapor-adsorbing passages, the pair of second openings being formed at a given interval away from each other across said inlet port.

13. A canister for use in an evaporative emission control system comprising:

a box-like casing having a first end wall and a second end wall opposite the first end wall;

an inlet port formed in the first end wall of said casing through which fuel vapors are drawn into the canister;

plurality of vapor-adsorbing passages each of which is filled with an adsorbing substance and has a given length through which the fuel vapors drawn from said inlet port flow, said vapor-adsorbing passages being defined within said casing in parallel to flow of the fuel vapors;

a flow dividing plate disposed between said inlet port and said vapor-adsorbing passages for distributing the fuel vapors entering from said inlet port to be uniform in flow rate to said vapor-adsorbing passages;

said flow dividing plate having formed therein a plurality of passages, and a plurality of openings, each of said openings directing the fuel vapors to one of said vapor-adsorbing passages; and said casing defining a first chamber and a second chamber between the first end wall and said flow dividing plate, the first chamber establishing fluid communication between said inlet port and said vapor-adsorbing passages through the opening of said flow dividing plate, the second chamber establishing fluid communication between the purge port and said vapor-adsorbing passages through the passages formed in said flow dividing plate.

14. A canister as set forth in claim 13, wherein each of the passages formed in said flow dividing plates is defined by a cylindrical bore extending parallel to flow of the fuel vapors, communicating with one of said vapor-adsorbing passages.

15. A canister for use in an evaporative emission control system comprising:

a box-like casing having a first end wall and a second end wall opposite the first end wall;

an inlet port formed in the first end wall of said casing through which fuel vapors are drawn into the canister;

a plurality of vapor-adsorbing passages, each of which is filled with an adsorbing substance and has a given length through which the fuel vapors drawn from said inlet port flow, said vapor-adsorbing passages being defined within said casing in parallel to flow of the fuel vapors;

a flow dividing plate disposed between said inlet port and the vapor-adsorbing passages for distributing the fuel vapors entering from said inlet port to be uniform in flow rate to said vapor-adsorbing passages;

said flow dividing plate having formed therein a plurality of openings each directing the fuel vapors to one of said vapor-adsorbing passages; and wherein if a total area of the openings of said flow dividing plate is defined as S', a total area of cross sections of said vapor-adsorbing passages is defined as S, and a cross sectional area of said inlet port is defined as s, the following relation is satisfied;

$$1/5 \leqq S'/S \leqq (S-1.2s)/S$$

* * * * *